United States Patent [19]

Robinson

[11] Patent Number: 4,522,014

[45] Date of Patent: Jun. 11, 1985

[54] ON-BOARD FLAP OPENER

[75] Inventor: Chris E. Robinson, Akron, Ohio

[73] Assignee: Figgie International, Willoughby, Ohio

[21] Appl. No.: 440,633

[22] Filed: Nov. 10, 1982

[51] Int. Cl.[3] ..... B65B 43/26; B65B 43/38

[52] U.S. Cl. ..... 53/382

[58] Field of Search ..... 53/50, 76, 381 R, 382, 53/468; 493/177, 183, 453

[56] References Cited

U.S. PATENT DOCUMENTS

| | | | |
|---|---|---|---|
| 3,201,916 | 8/1965 | McGill | 53/382 |
| 3,309,842 | 3/1967 | Arnett | 53/382 |
| 3,376,692 | 4/1968 | Berney | 53/382 |
| 3,852,942 | 10/1974 | Johnson et al. | 53/382 |
| 4,191,005 | 3/1980 | Vinoskey | 53/382 |

*Primary Examiner*—Robert L. Spruill
*Assistant Examiner*—Richard M. Mudd
*Attorney, Agent, or Firm*—Oldham, Oldham & Weber Co.

[57] ABSTRACT

A packing case flap opener apparatus for use on a packing case moved through a fixed course and wherein a control or travel cylinder is positioned to move parallel to the carton axis; the cylinder controls the position of a shaft operatively secured thereto and extending out to position a flap opening device which, in turn, engages an associated control member so that as the control cylinder is moved along on its axis of movement, the flap opening device is brought into engagement with both the leading and then later the trailing flap of a case for opening same by controlled flap opening action.

12 Claims, 11 Drawing Figures

ON-BOARD FLAP OPENER

TECHNICAL FIELD

This invention relates to packing case flap opener apparatus especially of the type where the packing case is moved along a fixed course and one means is provided to open both the leading and trailing flaps on a packing case being moved through the apparatus for receipt of articles therein.

BACKGROUND ART

Heretofore there have been many different types of flap openers provided for use in conjunction with other apparatus and especially for article packaging operations. One prior U.S. Pat. No. 3,201,916, utilizes a pin that can be projected out into the path of movement of a case to move under a flap thereof and then the pin and its mounting arm can be swung through an arc for flap opening action. A rotary action is provided for a flap opening member positioned for movement longitudinally of a carton moving path so that the flap opening member has a helical path in U.S. Pat. No. 3,852,942. Other known apparatus has used flap opening means moved longitudinally of a path of carton movement by external members such as piston and cylinder combinations and this type of construction is found in U.S. Pat. Nos. 3,309,842 and 3,376,692. In the latter patent, there is a curved guide slot provided for engaging a cam follower roll operatively carried by the end flap opening assembly.

All of these foregoing constructions are adapted to open just one flap in the case, ususally the leading flap of the case, and addition means must be provided for opening a trailing flap of the case.

It will be appreciated that case or carton processing apparatus including flap openers is used extensively industrially and any apparatus that can improve or speed up such flap opening actions or make them more positive in action or to reduce the amount of apparatus involved for such action would be very desirable.

DISCLOSURE OF THE INVENTION

The general object of the invention is to provide a novel and improved flap opener for use with packing cartons and especially to flap opener apparatus that can open both a leading and a trailing flap on a carton or case being moved, under controls, through a fixed path by the same member.

Another object of the invention is to utilize a cam actuator and a second member such as a Geneva cam in apparatus for opening flaps on a carton.

Yet another object of the invention is to provide fluid driven flap opening apparatus that will function effectively over a long period of time and provide a positive flap opening action by one member for the leading and trailing flaps of a carton being moved through a carton opening apparatus preparatory for deposit of articles therein which member has position controlled flap opening apparatus that can be moved longitudinally of a carton when its forward progress is stopped to obtain a flap opening movement by a rotary opener device and to use the same device to open a second flap by relative movement of the carton and the rotary opener device.

Another object of the invention is to provide a common fluid power circuit for both movement of a control shaft longitudinally of a carton, and rotary movement of the shaft and to reverse the drive power direction at a controlled time in the flap opening cycle.

Another object of the invention is to control a flap opener device, such as a paddle, for a carton by a means for moving the paddle longitudinally of the carton and by a second means to rotate the paddle on an axis normal to the longitudinal axis of the carton.

A further object of the invention is to coordinate the controlled movement of a carton along a fixed path with the controlled movement of a flap opening device along a path parallel to the carton's path combined with rapid arcuate movement of a flap engaging member forming part of the flap opening device.

Yet another object of the invention is to combine a mechanical control for a rotary shaft flap opener device with a fluid power operated rotary device connecting to the rotary shaft for controlled flap opening action by the flap opener device.

Another object of the invention is to provide a rapid action, controllable speed, improved flap opener apparatus for both leading and trailing end flaps of a carton, and to provide a positive, dependable flap opener action for case packers or other apparatus.

The foregoing and other objects will be made apparent as the specification proceeds. For a better understanding of the invention, reference should be made to the accompanied drawings, wherein.

When referring to corresponding members shown in the drawings and referred to in the specification, corresponding numbers are used to facilitate comparison therebetween.

BEST MODE FOR CARRYING OUT THE INVENTION

Figures 1, 2:
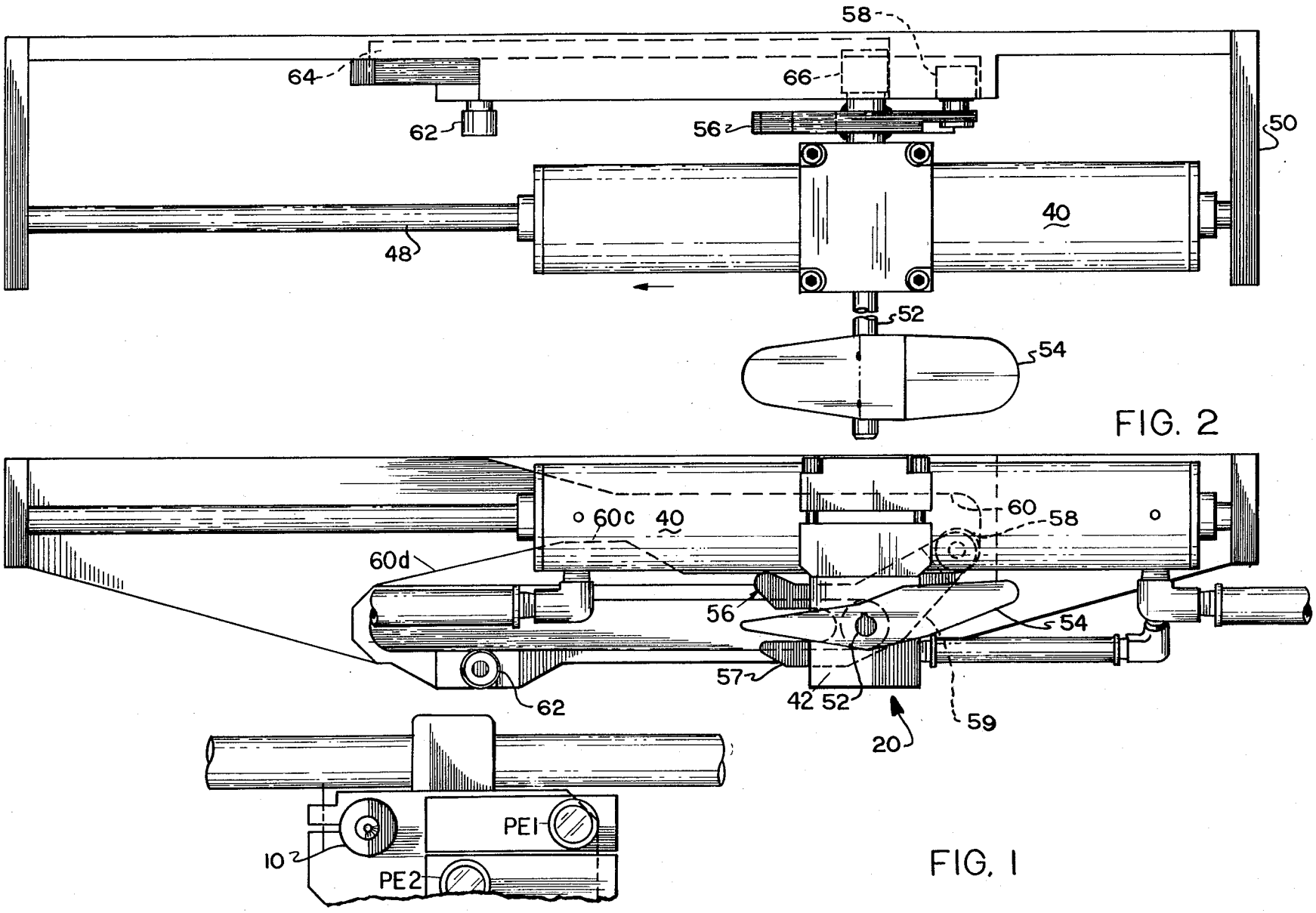
FIG. 1 is a fragmentary front elevation of the flap opener apparatus embodying the principles of the invention with the support apparatus for the associated case packing apparatus being omitted.
FIG. 2 is a plan view of the apparatus of FIG. 1.

In the apparatus of the invention, a substantially conventional control cam and timing shaft assembly (not shown) is provided in the case packer apparatus and this timing shaft is coupled to the drive for the case packer apparatus as to have one rotation for each cycle of flap opening action provided. That is for each case or carton processed, the timing shaft has one revolution and a conventional bar conveyor or the like in the apparatus moves the empty case longitudinally of the apparatus to and past the flap opener device for the desired flap opening action. One of the controls associated with the timing shaft and the packer apparatus includes two photoelectric eyes PE 1 and 2 as shown on FIG. 1. PE 1 is the upstream photoelectric eye and actuation of the upstream photoelectric eye or cell in turn actuates a conventional electrical control circuit 18 for the apparatus whereby a case stop means 10 is actuated to move its plunger 12 to its operative position. This case stop plunger 12 is extended out into the fixed path of movement of the case or carton 14 being processed to stop its downstream movement for flap opening action. Of course, the position of the cross bar drive in the conveyor moving the cartons 14 through the apparatus is correlated with the action of this case stop plunger 10 and other actions in the apparatus so as to release the carton 14 when the carton is ready to be moved further longitudinally of the apparatus.

The overall flap opener apparatus of the invention is indicated as a whole by the number 20 and this primarily is shown without any of the positioning frame of the case packer apparatus being directly indicated. The remaining portions of this case packing apparatus can be of any known construction. It will be appreciated that the case packer apparatus is set up to process something in the vincinity of 20 to 30 cases or cartons per minute whereby the action of the flap opener apparatus of the invention must be quite rapid and the cycle of operation of this apparatus can be controlled as hereinafter described in more detail insofar as the time of the operative cycle is required.

Figure 5:
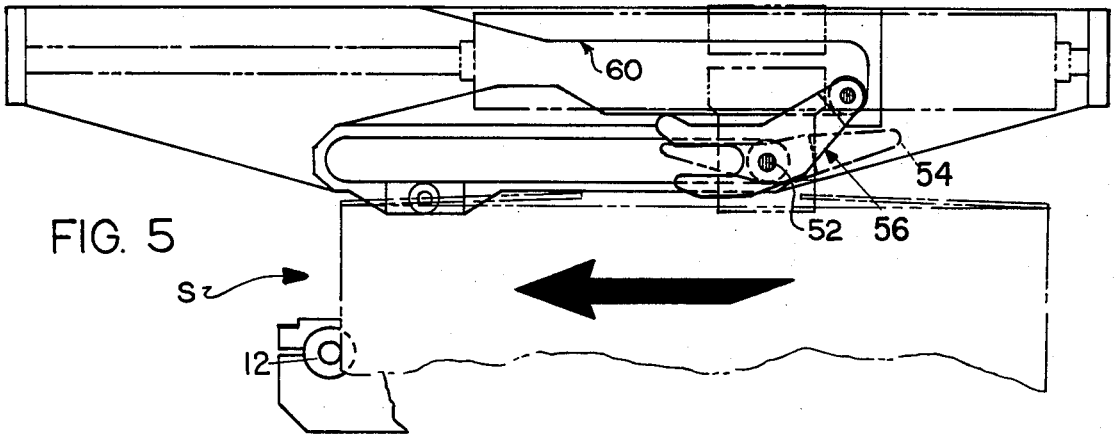
FIG. 5 is a diagrammatic view of the flap opener apparatus at its upstream end of travel showing a stopped empty carton in operative association with the flap opener apparatus.

The downstream photoelectric eye PE 2 is present at the flap opening station, which is indicated by the letter S in FIG. 5, to indicate when a carton is stopped in the apparatus by the case stop plunger 12 for flap opening action. Then if a carton is sensed at the photoelectric eye 2, the flap opener means of the invention can be started to move through an operative cycle.

The details of the control circuit 18 are not shown as conventional means are used for the control actions as desired.

Figure 4:
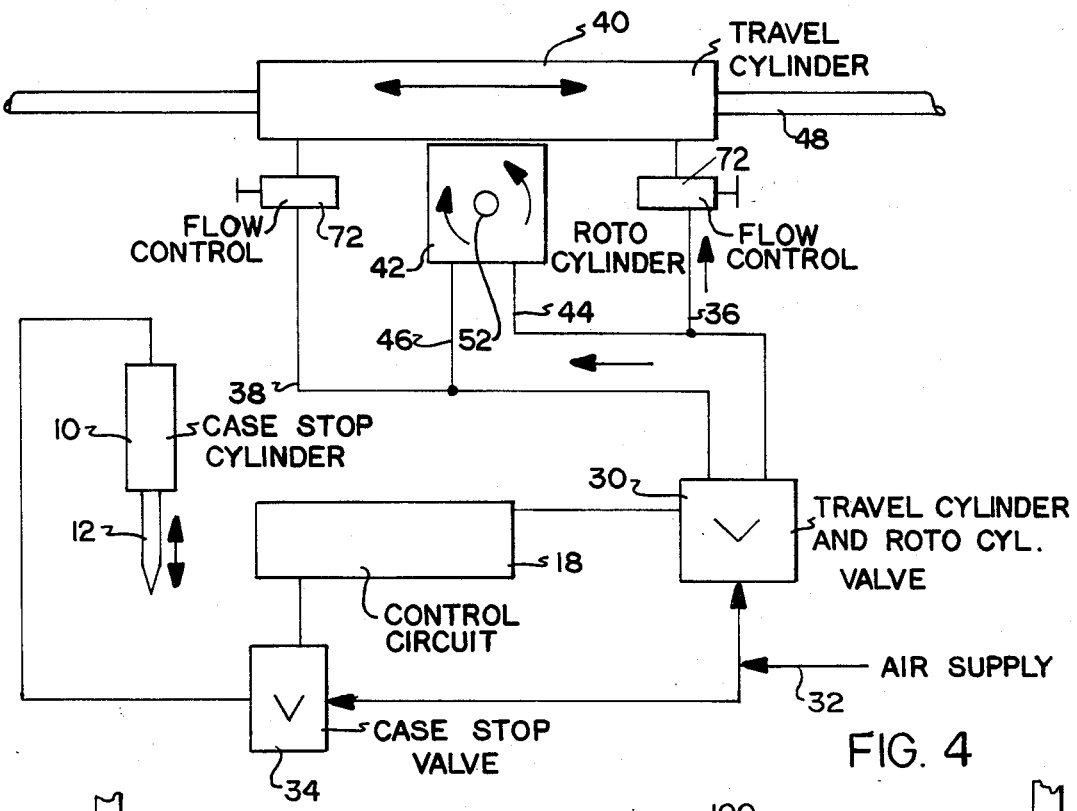
FIG. 4 is a diagramatic air supply/air flow diagram for the apparatus of the invention and its fluid power circuit.

The flap opener apparatus 20 is fluid power actuated and an air control and supply valve 30 is shown in FIG. 4. Any conventional type of an air supply means is connected to a fluid pressure supply line 32 which connects to a valve 34 for actuating the cases top cylinder means 10 to operate the case stop plunger 12 and move it out to the operative position or retract it therefrom depending upon the air supply to the means 10 as determined by the case stop valve 34 and electrical control signal supply thereto. The air supply control valve 30 in turn connects to air supply lines 36 and 38 to a travel cylinder 40 provided in the apparatus for moving the actual flap opener device or means longitudinally in the apparatus.

The fluid power control circuit and means in the apparatus also includes a roto cylinder 42 that is physically affixed to cylinder 40 and it in turn is connected to the fluid power and supply lines 36 and 38 by lines 44 and 46 respectively.

As shown in the drawings, this travel cylinder 40 is mounted on a piston rod 48 that is secured to a substantially U-shaped frame section 50 which is suitably mounted on the frame for the case packer apparatus. Hence, the piston rod is stationary and the travel cylinder 40 moves longitudinally of the apparatus, as hereinafter described.

The roto cylinder 42 has an operative shaft 52 extending therethrough and this roto cylinder is adapted to put a turning torque or force on the shaft when air is supplied thereto and with the direction of torque being reversible depending upon the setting of the 4-way air supply valve 30.

In order to control the desired flap opening action in the apparatus of the invention, this shaft 52 of the roto cylinder 42 extends beyond such cylinder out into the fixed path of movement of the carton 14 and a flap opening device such as a paddle 54 is secured to a protruding end of this shaft 52. The shaft 52 also extends away from the part of the movement of the carton and it has a suitable operative or control device such as a Geneva cam 56 secured thereto. A control guide or roll 58 is suitably rotably secured to one end of the Geneva cam 56 and the roll in turn engages with a control wall or means 60 formed in the frame 50.

It will be seen that the Geneva cam 56 comprises one bifuracated end 57 and a solid leg or section 59 for control action as described hereinafter.

By combining the control action obtained by the Geneva cam 56 in association with a cam control roll 62 provided adjacent the downstream end of movement of the control cylinder 40 with the pneumatic spring or flexible rotary force action applied to this shaft 52 a desired flap opening action as hereinafter described, is obtained.

FIG. 1 thus shows that at the start of the cycle of flap opening action, the flap opening device or paddle 54 is positioned substantially horizontal and it is clear from the carton 14 and flaps thereon. As the case is moved longitudinally through the apparatus it moves to a position below the flap opener apparatus 20. At that time, the air supply to the roto cylinder is such as to urge the shaft 52 and the Geneva cam 56 in a clockwise direction. This insures that the control roller 58 is moved to its position on the lower wall of the control slot provided in the frame 50, as indicated in FIGS. 1 and 5.

To start the flap opening action from the upstream end position, FIG. 5, of the travel cylinder 40, the control circuit 18 actuates the travel cylinder and roto actuator valve 30 to change air supply to the travel cylinder to move it to the left or downstream in the schematic circuit shown in FIG. 4. The movement of the travel cylinder is controlled, by this piston rod 48, and its sliding movement also is controlled by a guide track or slot 64 formed in the frame 50 or a member secured thereto. The rotary shaft 52 has a cam follower or a roll 66 operably secured to its end and engaging this guide slot 64. This insures a positively controlled position for the shaft 52 and the rotary actuator 42 with longitudinal movement of the travel cylinder 40.

Figure 6:
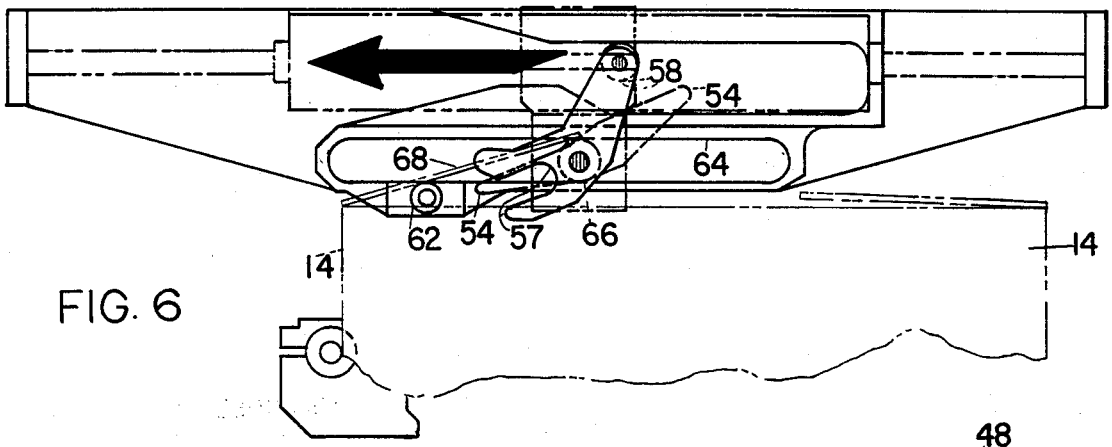
FIG. 6 is a diagrammatic view like FIG. 5 of the flap opener apparatus as it has been moved downstream and the flap opener device is in operative engagement with a flap on the carton being processed.
Figure 7:
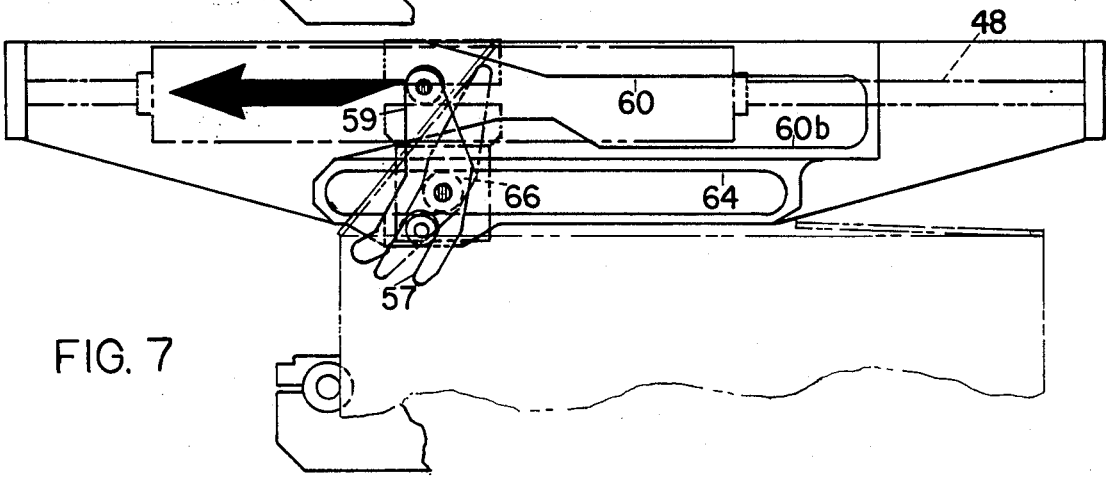
FIG. 7 is a diagramatic view showing the next step of flag opening action by the apparatus of the invention.

This change in direction of air flow or power supply to the travel cylinder 40 and the roto cylinder 42 urges the shaft 52 arcuately in a counter-clockwise direction and this brings the paddle 54 to a operative angular position indicated in FIG. 6. This action occurs substantially instantly when the position of the travel cylinder and rotary actuator valve 30 is changed whereby such paddle 54 is inserted under the leading end flap 68 of the carton 14 with longitudinally movement of the flap opening assembly. Continued longitudinal movement of this flap opening assembly brings the bifurcated end 57 of the Geneva cam into engagement with the cam actuator 62 and, as shown in FIG. 7, at that time the combined longitudinal movement of the travel cylinder and the action on the Geneva cam by the cam actuator 62 engaging such cam produces a very rapid arcuate movement of the paddle 54 and the opening of the leading flap 68 to the angular position shown in FIG. 8. At that time any other suitable means, as desired, can be brought into engagement with the flap 68 to retain it at an open position or else it will just retain a given position by gravity action.

Figure 8:
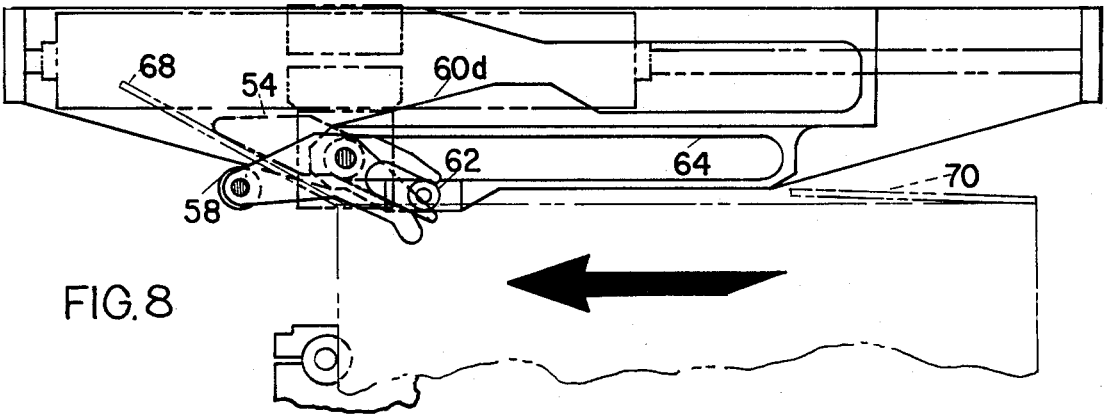
FIG. 8 is a daigramatic view like the preceding views showing the next step in the flap opening action when the flap opener apparatus has opened one flap and it has reached its furthest downstream position.
Figure 9:
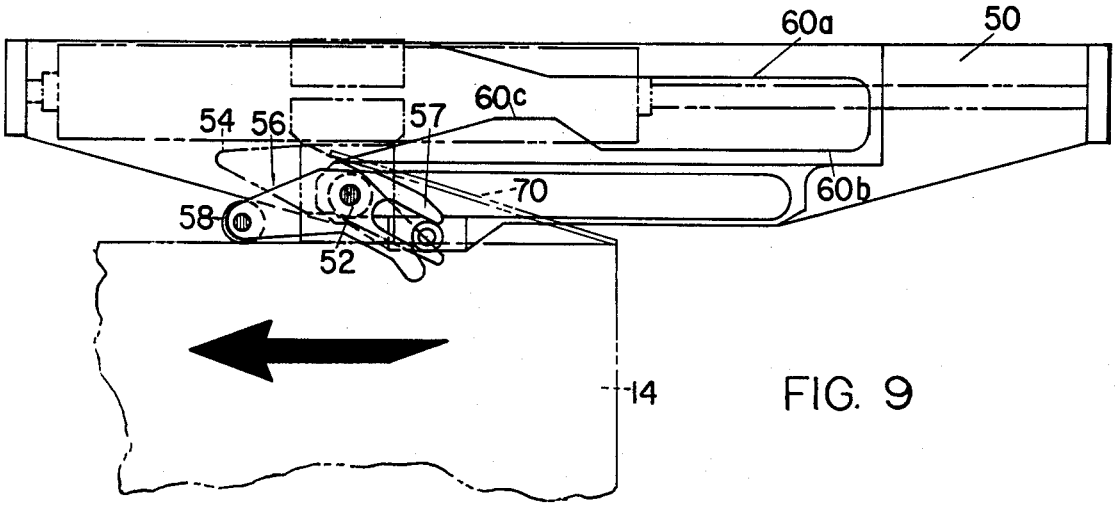
FIG. 9 is a diagrammatic view like FIGS. 5–8 but showing the case released and the flap opener device engaging the trailing flap of the carton being processed.

Next the control circuit 18 is so designed as to release or reverse the actuation of the case stop means and retract its operating plunger 12 whereby the case 14 is released to start movement downstream as it is substantially simultaneously engaged with its drive conveyor (not shown) so that the case 14, as shown in FIG. 9, has moved downstream. The paddle 54 remains in substantially the same position as shown in FIG. 8 and is so situated vertically in relation to the fixed path of movement of the case 14 as to engage in under the trailing case flap 70.

Figure 10:
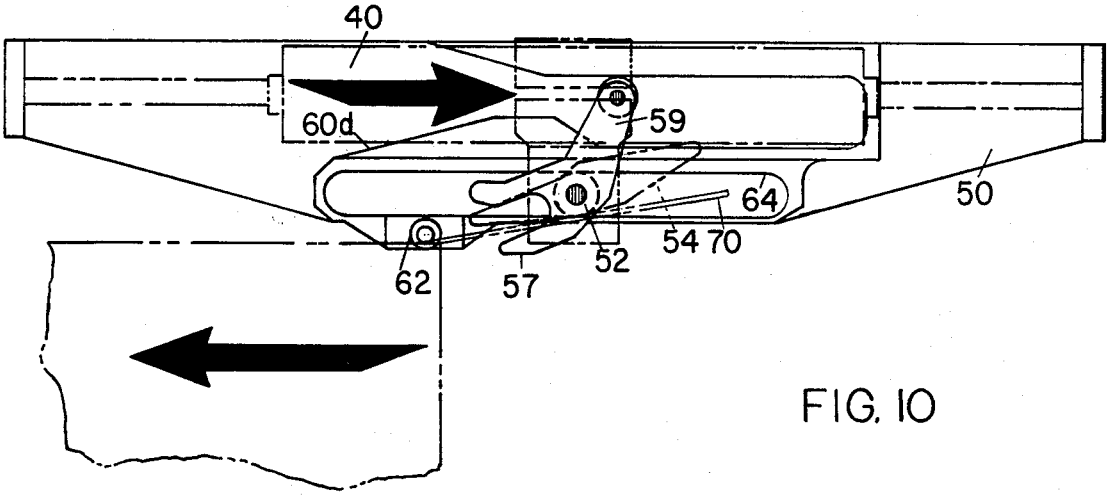
FIG. 10 is a view of the flap opener apparatus showing the progressive flap opening action on the trailing flap of the moving carton.
Figure 11:
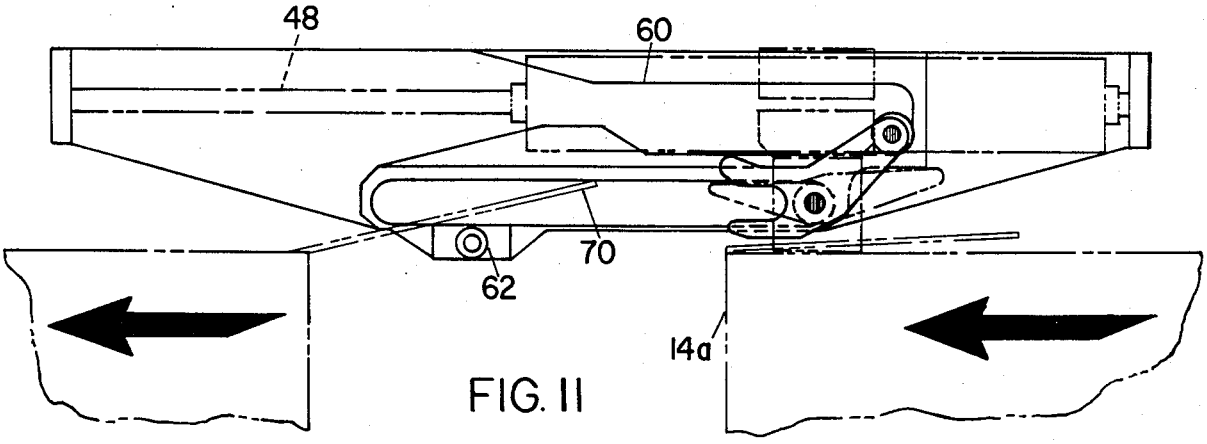
FIG. 11 is a diagrammatic view of the flap opening apparatus showing it in its maximum upstream position with the flap opening device having completed a cycle of flap opening actions and with a new carton moving into the apparatus for processing.

Very promptly after the paddle of flap opening device has engaged under the trailing flap 70, the travel cylinder 40 is moved upstream in the apparatus and this provides a very rapid arcuate movement for the shaft 52 because the Geneva cam is still in engagement with the cam actuator 62. The initial upstream movement of this control cylinder results in the flap opening action as shown in FIG. 10. The case 14 is moving downstream of the apparatus concurrently with the upstream movement of the travel cylinder. Then when the cam actuator 62 is out of engagement with the Geneva cam, the rotary cylinder is urged to its maximum movement position in a clockwise direction whereby the roll 58 on the Geneva cam moves down against the bottom control wall to position this paddle 54 in a substantially horizontal position, as shown in FIG. 11. But normally the roto cylinder 42 has previously turned the shaft 52 and the FIG. 10 position would have the roll 58 against the bottom wall of the control means 60. The complete cycle of operation of flap opening action has been obtained, as shown in FIG. 11, and the paddle 54 is so positioned as to enable the leading end flap on the next carton 14*a* to be processed to move under and past the paddle. The carton 14*a* will move down and be engaged by the stop cylinder or means 10.

So as to control the speed of longitudinal movement of the travel cylinder 40, pressure control valves or devices 72 are provided in each of the fluid power supply lines 36 and 38 connecting to the travel cylinder whereby the air pressure supplied to the travel cylinder can be varied to increase or decrease the speed of longitudinal movement thereof, as desired.

By the flap opener apparatus of the invention, a very rapid, positive acting flap opening action has been obtained and such action is facilitated because the paddle 54 functions to open both the leading and trailing flaps of a carton being processed. The use of the one control means for the flap is submitted to reduce the number of parts and/or actions required for flap opening action. The apparatus of the invention is not complex and the components of the apparatus will provide good service life with a minimum of maintenance. Hence it is believed that the objects of the invention have been achieved.

The roll 58 has vertical clearance in the control means 60 to move between the upper wall 60*a* and bottom wall 60*b* at the upstream portion of travel of the travel cylinder 40.

In the accompanied drawings, the fluid pressure supply lines are omitted in most of the diagramatic figures of the apparatus but with a portion of such lines or tubes being shown in FIG. 1.

Figure 3:
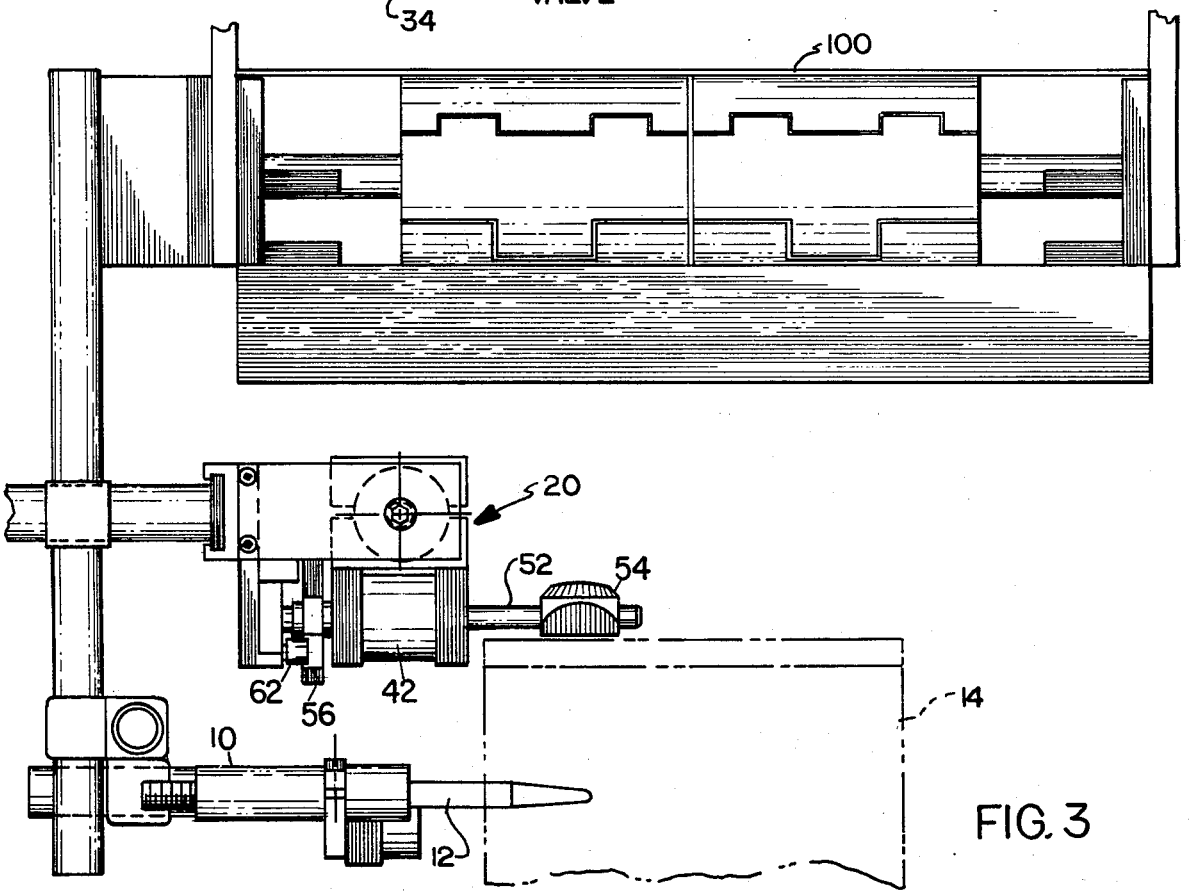
FIG. 3 is a fragmentary end view of portion of the case packer apparatus having the flap opening apparatus of the invention associated therewith.

FIG. 3 shows a portion of the case packer apparatus with which the flap opener is used and particularly an article feed convenyor 100 as used in case packer apparatus is shown. Such conveyor is positioned above the carton processing apparatus of the present invention.

It should be realized that when the operative paddle 54 which is the flap opener device in the apparatus of the invention engages a carton flap, relative sliding movement between the paddle and the carton flap occurs readily as the paddle has a flat contact surfaces that facilitates sliding movement of a carton flap thereover.

It should be noted that the control slot or means has an upper substantially flat wall section 60*a*, an upstream lower flat section 60*b*, and an elevated section 60*c* is provided adjacent the downstream end of this control slot which terminates in a downwardly inclined wall section 60*d*. This control means or slot 60 is a safety member to avoid any jam in the apparatus should there be a mistake in the timing or functioning of the roto actuator 42. It should be appreciated that the bifurcated end of the Geneva cam 57 is retained in engagement with the cam actuator roll 62 at all times when the control cylinder 40 is at or adjacent its downstream end of movement, as best shown in FIGS. 8 and 9 of the drawings. Thus the actuator controls the Geneva cam positively and arcuate movement of the common shaft 52, depending upon which direction the control cylinder is being moved longitudinally on the apparatus, is obtained. The control roll 58 is disengaged from the control means 60 when the control cylinder is at its downstream end of travel. If there is any mistake in the action or setting of the roto actuator 42 and the Geneva cam is not moved in a clockwise direction rapidly upon start of the upstream movement of the control cylinder, the control roll 58 on the Geneva cam should engage the upwardly extending wall 60*d* of the means 60 to start the Geneva cam on a clockwise movement towards the operative positions shown in FIGS. 10 and 11 of the drawings.

While one complete embodiment of the invention has been disclosed herein, it will be appreciated that modification of this particular embodiment of the invention may be resorted to without departing from the scope of the invention.

What is claimed is:

1. In a flap opener apparatus, a travel cylinder, having a longitudinal axis, movable parallel to a fixed carton moving path, a shaft operatively carried by said travel cylinder and positioned normal to said longitudinal axis thereof, a flap opening device, a control cam, and a control roll all operatively positioned on said shaft;

a control slot engaging said control roll and operable to move said shaft arcuately, a powered rotor means operatively connected to said shaft to urge it through an arc when said shaft is free to move, and a cam operating member positioned to engage said control cam and move said shaft and said flap opener device through an arc to open a flap when said travel cylinder has moved to adjacent a limit of its travel and has said device under a flap of a case.

2. In a flap opener apparatus used with cartons moved through a fixed path by a drive conveyor and having a stopped position, a flap opener means including a flap engaging device having a plurality of arcuate positions, a Geneva cam and a control means mounted on a common shaft, a fluid driven travel cylinder engaging said flap opener means to reciprocate it, said travel cylinder having upstream and downstream ends for its movement, a control slot engaging said control means to at least aid in controlling the path of said flap opener means and the arcuate position of said flap engaging device as said flap opener means is reciprocated, a fluid driven rotary cylinder operatively connected to said common shaft and operable to urge said common shaft arcuately, said rotary cylinder being carried by said travel cylinder, and a cam actuator positioned to engage said Geneva cam and rotate said common shaft and flap opener device through a controlled arc to open a leading flap, said flap opener device being retainable in position to engage under a trailing flap of said carton by release of said carton for further movement along its fixed path.

3. In a flap opener apparatus as in claim 2 wherein means connect to said travel cylinder and to said rotary cylinder to reverse the direction of drive thereof whereby said common shaft is moved through an arc to move said flap engaging device to open the trailing flap of said carton.

4. In a flap opener apparatus as in claim 2 wherein said control slot and control means move said flap opening device to an inoperative position out of contact with any flap at the upstream end of movement of said travel cylinder.

5. In a flap opener apparatus as in claim 2 wherein a stop means is provided to engage a carton and prevent its movement along said fixed path while said leading flap is opened, and a control means releases said stop to permit movement of said carton downstream on said fixed path, said flap opening device being retained in position to engage the trailing flap of the carton being processed.

6. In a flap opener apparatus as in claim 2 wherein said common shaft is on a axis above a carton on its fixed path, said flap opening device comprising a paddle means extending in two directions from said common shaft, said paddle means including an end section movable downwardly sufficiently to engage under carton flaps for swinging the same to open positions.

7. In a flap opener apparatus as in claim 2 wherein said cam actuator is positioned adjacent the downstream end of movement of said travel cylinder, and said cam actuator remains in engagement with said Geneva cam at all times when said travel cylinder is at and adjacent its downstream end of movement.

8. In a flap opener as in claim 2 wherein said control slot has top and bottom wall sections engageable by said control means at upstream portions of movement of said travel cylinder.

9. In a flap opener as in claim 8 wherein said bottom wall has a downstream end section including an elevation portion and a downwardly inclined end that releases said control means at the downstream end of movement of said travel cylinder.

10. In a flap opener apparatus used with cartons moved through a fixed path by a drive conveyor and having a stopped position, a flap opener means including a flap engaging device, and a Geneva cam mounted on a common shaft, a control means mounted on a leg of said Geneva cam, a fluid driven double acting travel cylinder and piston rod means engaging said flap opener means to reciprocate it, said travel cylinder and piston rod means having a longitudinal axis of movement and being provided with upstream and downstream ends of motion, a control slot means engaging said control means but providing some freedom for vertical movement of said control means to at least said in controlling the arcuate position of said flap engaging device as said flap opener means is reciprocated, a fluid driven rotary cylinder operatively connected to said common shaft and operable to urge said common shaft arcuately, and a cam actuator positioned to engage said Geneva cam and rotate said common shaft and flap opener device through a controlled arc to open a leading flap when said common shaft approaches its downstream end of its motion.

11. In a flap opener apparatus as in claim 10 wherein means connect to said travel cylinder and piston rod means and to said rotary cylinder to reverse the direction of fluid power supply thereto so that said commons shaft is moved upstream and through an arc to move said flap engaging device to open the trailing flap of said carton.

12. In a flap opener apparatus as in claim 10 wherein said common shaft is normal to the longitudinal axis of said travel cylinder and piston rod means and said common shaft has a free end engaging a guide means permitting movement of said common shaft parallel to the longitudinal axis of said travel cylinder and piston rod means.

* * * * *